US005148914A

United States Patent [19]

Budert et al.

[11] Patent Number: 5,148,914

[45] Date of Patent: Sep. 22, 1992

[54] BOX FOR DISPLAY AND STORAGE OF ELONGATED OBJECTS

[75] Inventors: Günter H. Budert, Bachhagel; Willi Platte, Attendorn; Gerhard Riess, Bachhagel-Burghagel; Georg Rau, Giengen-Hohenmemmingen; Werner Hitzler, Herbrechtingen, all of Fed. Rep. of Germany

[73] Assignee: Firma Georg Knoblauch, Giengen/Brenz, Fed. Rep. of Germany

[21] Appl. No.: 766,728

[22] Filed: Sep. 26, 1991

[30] Foreign Application Priority Data

Sep. 26, 1990 [EP] European Pat. Off. ..... 90118434

[51] Int. Cl.[5] ..... A45G 13/10; B65D 85/24; B65D 43/16

[52] U.S. Cl. ..... 206/1.5; 206/379; 206/807; 220/265

[58] Field of Search ..... 206/379, 807, 1.5; 220/265

[56] References Cited

U.S. PATENT DOCUMENTS 2,269,637 1/1942 Polkosnik ..... 206/379
3,018,876 1/1962 Huot ..... 206/379
4,610,371 9/1986 Karknewicz ..... 206/807 X
4,763,732 8/1988 Neal ..... 220/265

*Primary Examiner*—William I. Price
*Attorney, Agent, or Firm*—Herbert Dubno; Andrew M. Wilford

[57] ABSTRACT

A box for the storage and display of elongated objects has a base part and a cover part that is recessed in the base part. More particularly the base part has a floor having a pair of parallel side edges and an end edge bridging the side edges, respective side walls projecting upward from the side edges and in turn having upper edges, and an outer end wall bridging the side walls and projecting upward from the end edge. The cover part has a face plate, is hinged on the base part, and is pivotal thereon between an open position projecting upward from the base part and a closed position with the face plate lying wholly within the base part below the upper edges of the side walls. In addition the cover part is formed with a laterally projecting grip tab coplanar with the face plate. A frangible latch element connected between the cover and base parts in the closed position of the cover part retains same therein so that the cover part can only be moved into the open position after breaking of the latch element.

10 Claims, 6 Drawing Sheets

BOX FOR DISPLAY AND STORAGE OF ELONGATED OBJECTS

FIELD OF THE INVENTION

The present invention relates to a box for the storage and display of elongated objects. More particularly this invention concerns a box for point-of-sale display of sets of drill bits, saw blades, and the like that can also be used for tool-box storage of these articles.

BACKGROUND OF THE INVENTION

A standard display/storage box has a base part and a cover part hinged on it. The base part has a floor from whose side edges project side walls and the cover part normally fits over the side walls and protects the contents of the box. Normally the cover is transparent to show what is in the box, and a seal or some similar latch member is provided to give some evidence that the cover has been opened.

The main problem with such a display box is that it is possible to deform the cover somewhat and withdraw part of the contents of the box without breaking the seal. The unsuspecting purchaser therefore ends up with an incomplete set of the articles he or she was buying.

In addition the covers on such boxes tend to get scratched even before sale. This happens when the boxes are stacked up with the back of one box lying directly on the transparent cover of the underlying one. Obviously this hurts their appearance and the likelihood that they will sell.

OBJECTS OF THE INVENTION

It is therefore an object of the present invention to provide an improved display/storage box for elongated articles.

Another object is the provision of such an improved display/storage box for elongated articles which overcomes the above-given disadvantages, that is which cannot be partially opened to remove some of its contents without leaving obvious evidence of this tampering, and that is not likely to get scratched prior to sale.

SUMMARY OF THE INVENTION

A box for the storage and display of elongated objects according to the invention has a base part and a cover part that is recessed in the base part. More particularly the base part has a floor having a pair of parallel side edges and an end edge bridging the side edges, respective side walls projecting upward from the side edges and in turn having upper edges, and an outer end wall bridging the side walls and projecting upward from the end edge. The cover part has a face plate, is hinged on the base part, and is pivotal thereon between an open position projecting upward from the base part and a closed position with the face plate lying wholly within the base part below the upper edges of the side walls. In addition the cover part is formed with a laterally projecting grip tab coplanar with the face plate. A frangible latch element connected between the cover and base parts in the closed position of the cover part retains same therein so that the cover part can only be moved into the open position after breaking of the latch element.

Thus the cover of the box according to this invention cannot be deformed elastically to give enough access to the box's contents to get something out without breaking the latch element. Furthermore, the recessed cover, which is normally made transparent, will not be scratched when the boxes are stacked up.

According to further features of the invention the base side walls are each formed with a cutout opening at the respective upper edge and the cover part has two tabs projecting in the closed position into the respective cutouts. Furthermore the cover part has side walls lying in the closed position between and inwardly against the respective base side walls and covering the cutouts. The cutouts are generally half elliptical and the cover side walls are formed at the cutouts in the closed position with grip-enhancing ridges. This makes it very easy, once the latch element is eliminated, to open the box.

The base part according to the invention is formed at the end wall with an extension formed in turn with a throughgoing aperture and the end wall is formed at the aperture with a downwardly opening slot, the latch element having a thin neck part engaged through the slot. Furthermore the base is formed with an inner end wall parallel to but spaced from the outer end wall and the latch element has an inner portion lying between the first and second end walls. The first and second end walls form a passage snugly receiving the latch-element inner portion and this inner portion has a projection extending toward the cover. The cover has a ridge engaging under the projection in the closed position. The passage and inner portion are of complementary rectangular section. In addition the latch element has a head in the aperture and the thin neck portion extends through the slot between the head and inner portion.

The extension according to the invention is formed with a throughgoing hanging hole. An insert pivoted between the base part and the cover part is formed with seats for the objects and the parts have formations elastically retaining the insert in different positions relative to the base part.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
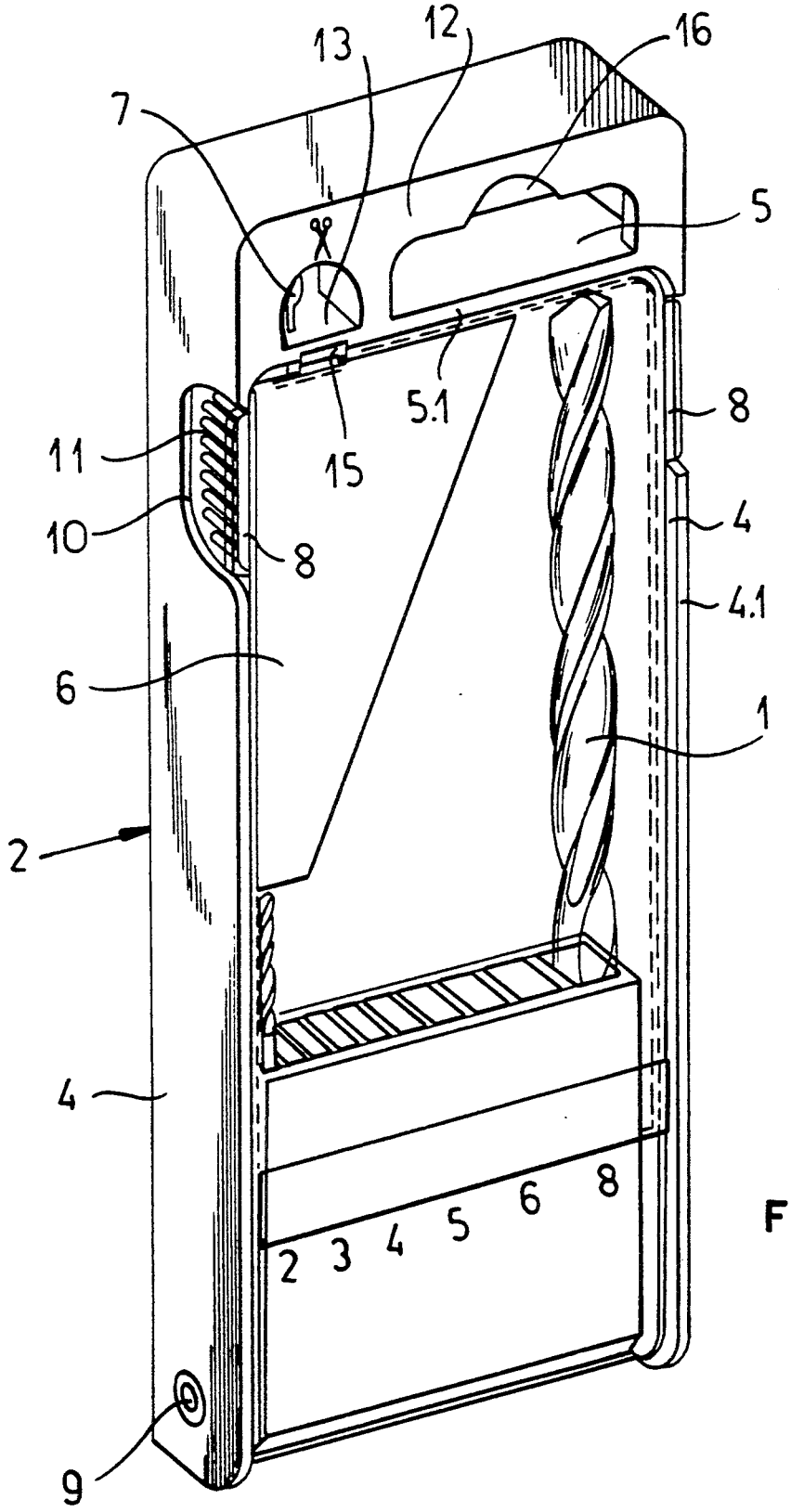
FIG. 1 is a perspective view of a display/storage box according to the invention.
Figure 2:
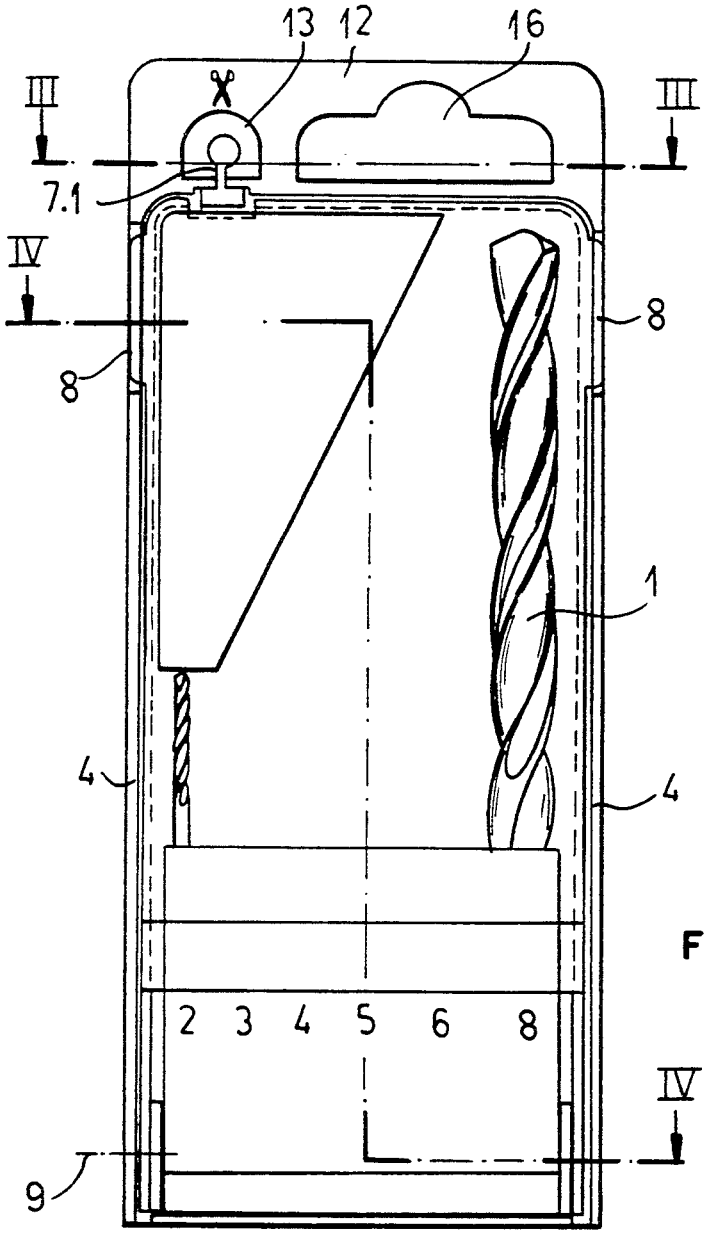
FIG. 2 is a front view of the box.
Figure 3:
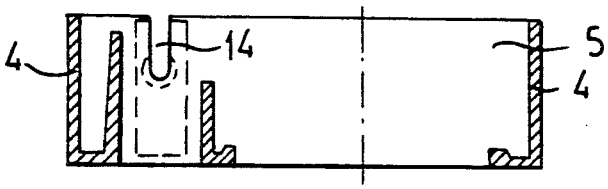
FIGS. 3 and 4 are cross sections respectively taken along lines III—III and IV—IV of FIG. 2.
Figure 4:
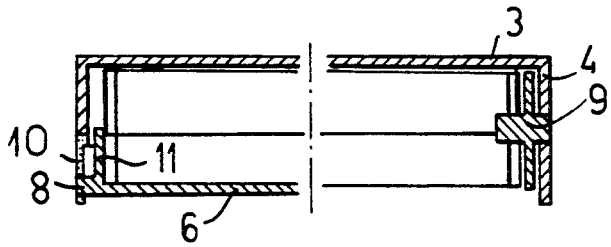
Figure 5:
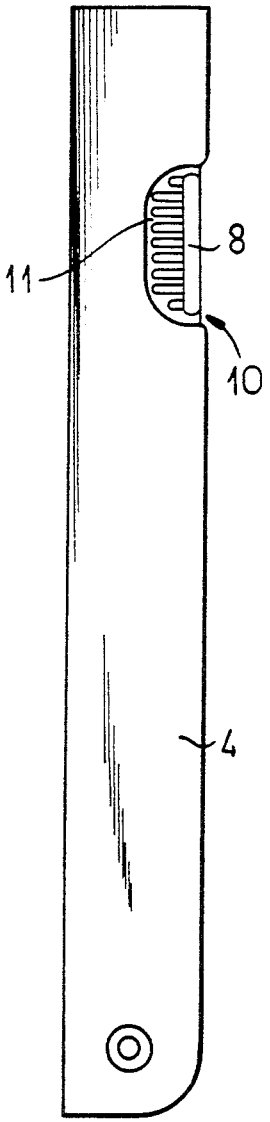
FIG. 5 is a side view of the box.
Figure 6:
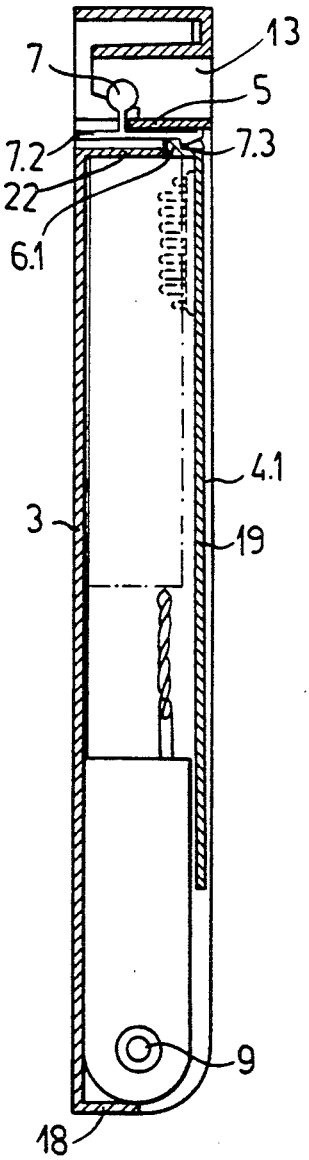
FIG. 6 is a longitudinal section through the box.

As seen in the drawing the box according to this invention is intended to hold a set of drill bits 1, although of course other articles could be held in it. The box comprises a base part 2, an insert 17 formed with seats holding the bits 1, and a cover part 6 that close up as shown in FIGS. 1 through 10 to form a parallepiped.

Figure 11:
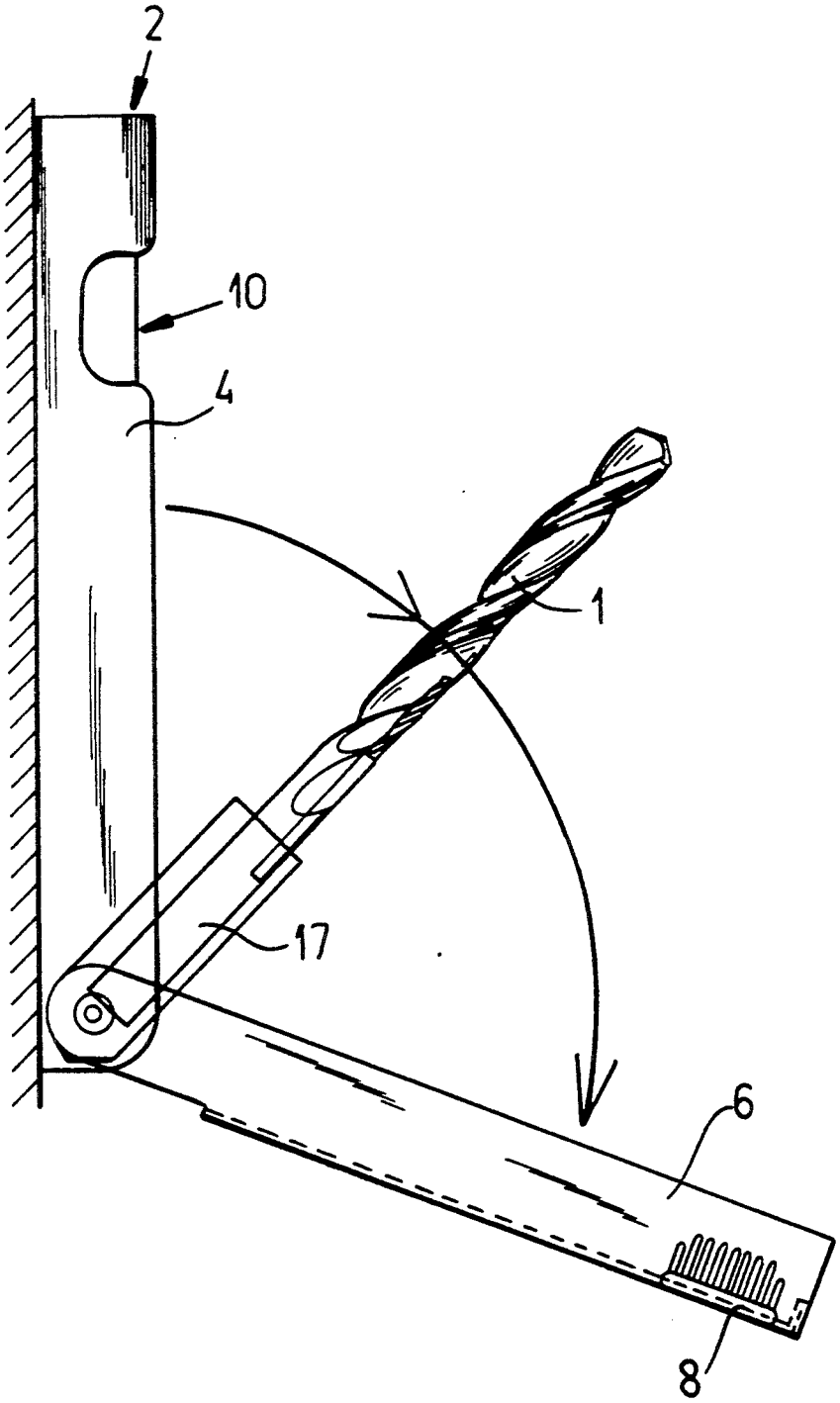
FIG. 11 is a side view of the box in a partially open position.
Figure 12:
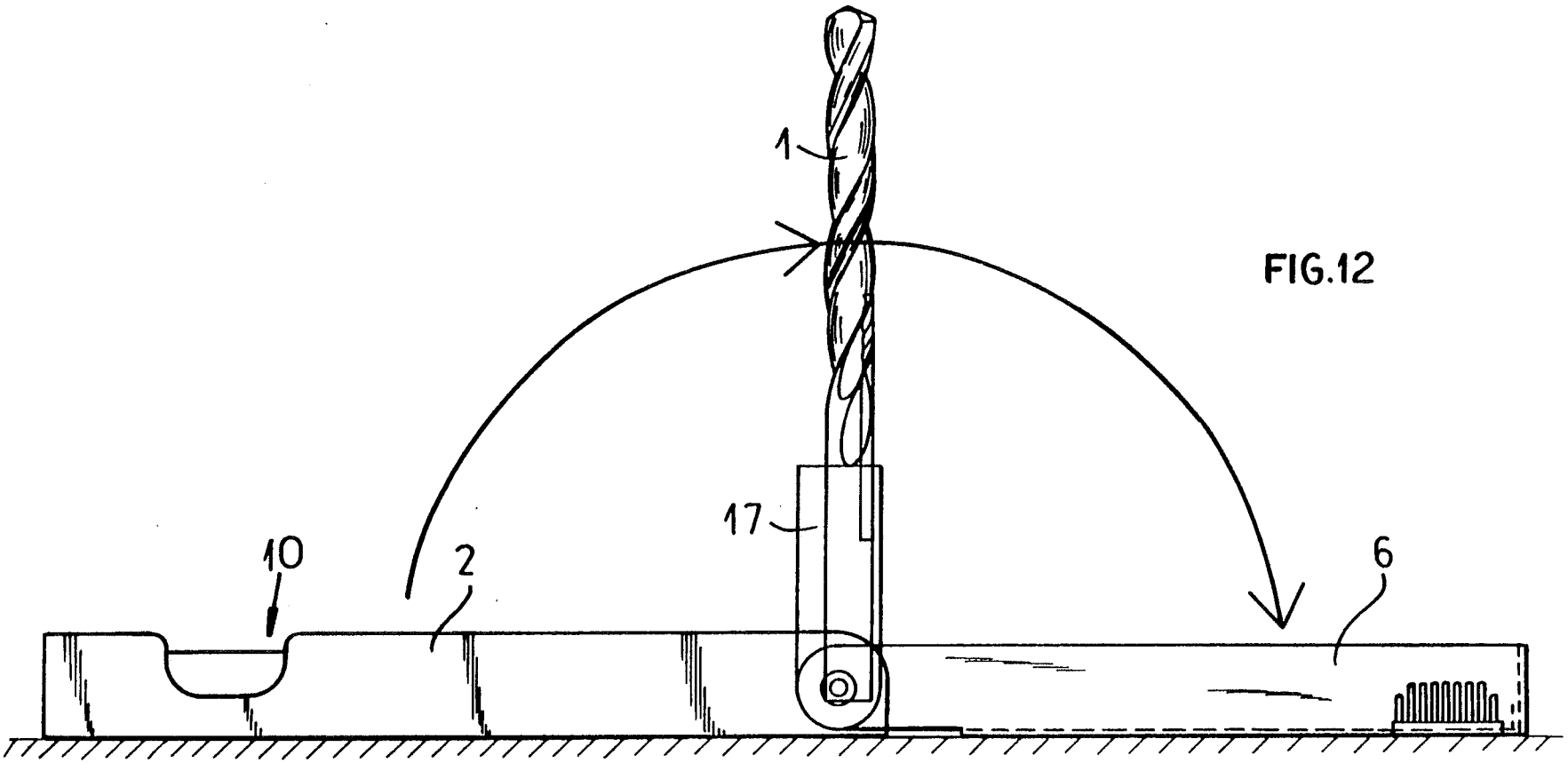
FIG. 12 is a side view of the box in the fully open position.

The cover 6 can be swung out as shown in FIG. 11 when the base 2 is secured to a wall to extend the bits 1 and insert 17 at a 45° angle to the horizontal, and when set on a surface as shown in FIG. 12 the cover 6 and base 2 are coplanar and the insert 17 and bits 1 extend perpendicularly between them. Formations shown at 22 in FIG. 7 on the parts 2, 6, and 17 elastically retain these parts in these positions.

The base part 2 has a floor 3 from whose longitudinal edges extend a pair of upstanding side walls 4 that extend parallel to each other and that terminate in coplanar outer edges 4.1. An end wall 5 bridges perpendicularly between the upper ends of the walls 4 and has an edge 5.1 that is coplanar with the edges 4.1. The end of the base 2 opposite the end wall 5 has a short end wall 18 (see FIG. 6) and the two side walls 4 form adjacent the lower end wall 18 a pair of pivots 9 on which the cover 6 and insert 17 are mounted.

Figure 7:
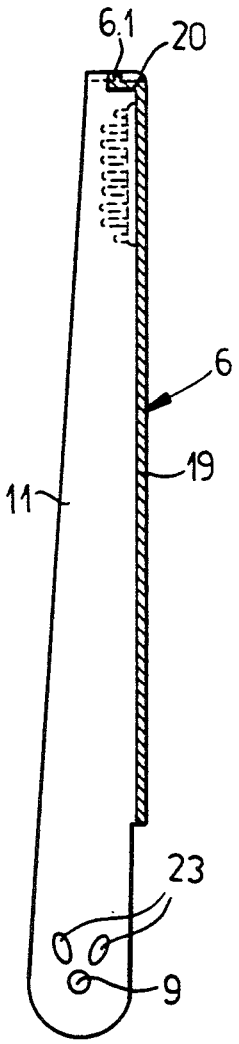
FIG. 7 is a longitudinal section through the cover of the box.
Figure 8:
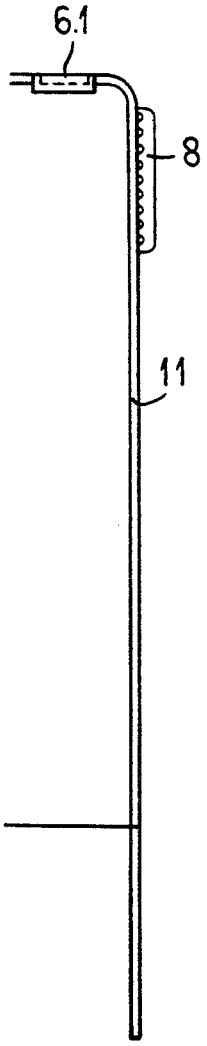
FIG. 8 is a detail front view of the box.
Figure 10:
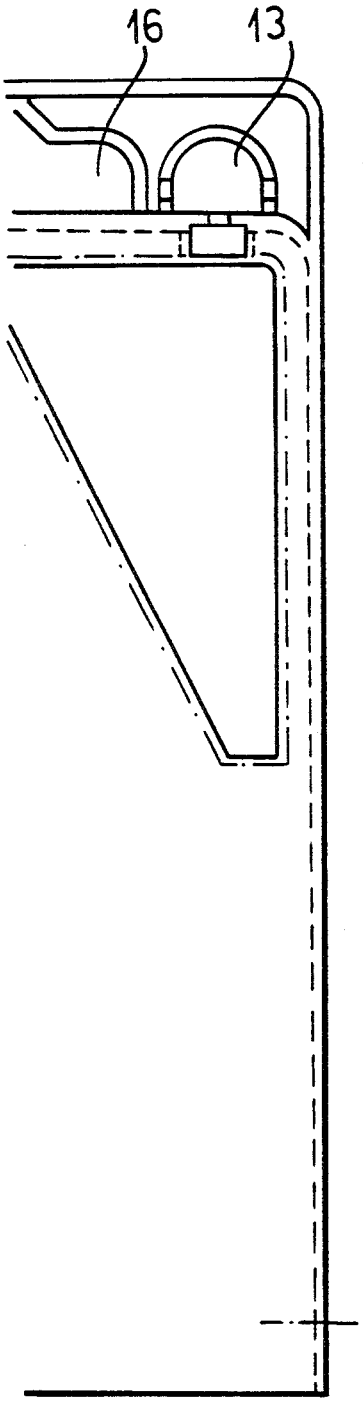
FIG. 10 is a back view of the part shown in FIG. 9.
Figure 9:
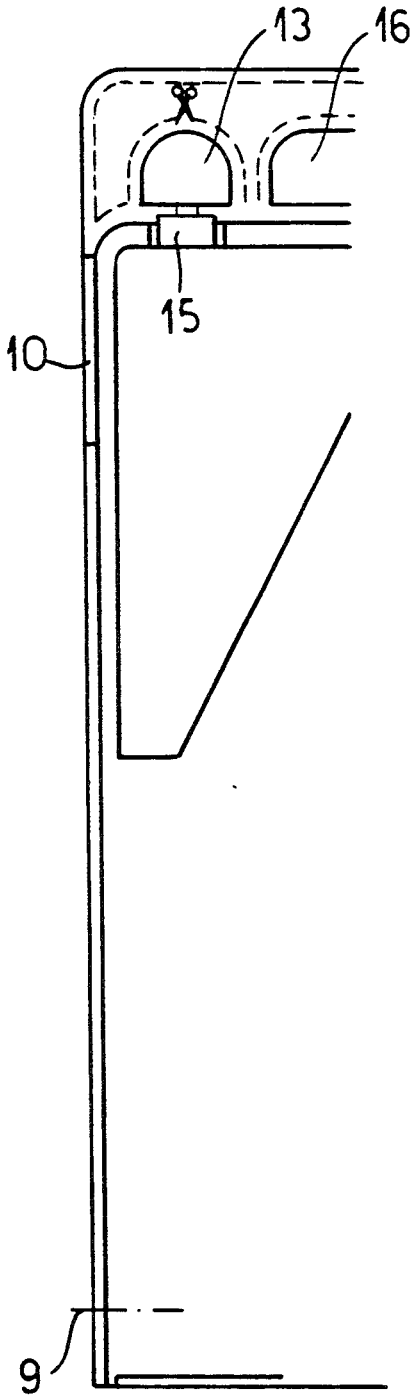
FIG. 9 is a detail view of the base part of the box.

The cover part 6 is formed of a transparent synthetic resin and basically comprises as seen in FIG. 7 a transparent face plate 19 from which extend two side lips or walls 11 that are somewhat shorter than the side walls 4 and that are spaced apart by a distance somewhat smaller than the spacing between the walls 4 so that the walls 11 can nest snugly between the walls 4. In addition the cover 6 has an end wall 20 that bridges the side walls 11 and that normally lies adjacent the end wall 5. The cover side walls 11 are pivoted at 9 on the base side walls 4. The dimensions of the cover 6 are such that when it is fitted in the closed position of FIGS. 1, 5, and 6 in the base part 2 the face plate 19 is recessed below the plane of the edges 4.1 of the base side walls 4. This prevents the plate 19 from getting scratched if something flat, like another such box, is stacked atop the box. In addition the end wall 20 extends below the wall 5 so that the cover 6 cannot be deformed elastically sufficiently to get the contents out of the box.

The base side walls 4 are each formed immediately below the end wall 5 with a generally half-elliptical cutout 10 open at the respective edge 4.1. The cover 5 is formed with laterally outwardly projecting tabs 8 that fit in these cutouts 10 and therebelow with ridges that enhance grip. Thus it is fairly easy for a user to grip the base 2 in one hand and the two tabs 8 in the other to open up the box.

Prior to first use the box 1 is equipped with a latch element 7 that is exposed in a semicircular-section cutout in a flap extension 12 of the upper end of the box. This element 7 has a thin neck 7.1 extending through a groove 14 formed in a web 22 extending parallel to the end wall 5 and opening at the back of the box. The lower edge of the cover end wall 20 sits atop the upper edge of the web 22 in the closed position of the box. The latch element 7 has a flat inner portion 7.2 fitting complementarily in a rectangular-section passage 15 formed between the cover and base end walls 5 and 20 and is formed with a longitudinal projection 7.3 that engages over a ridge 6.1 formed at a pocket in turn formed in the cover end wall 20 and confronting the passage 15.

Thus once the box 22 is filled and the cover 6 is closed, the latch member 7 is pushed into the groove 14 from the back. This pushes the wall 5 back elastically sufficiently that the projection 7.3 can snap over the ridge 6.1, locking the element 7 in place. In this position opening of the box is impossible without breaking it. This element 7 thus holds the box securely closed during shipping and storage, for which it can be hung from an opening 16 formed in the extension 12.

After purchase the latch member 7 is removed by snipping off its head in the cutout 13. This allows the inner part 7.2 to be pulled upward out of the base part 2 as the cover 6 is pulled open, whereupon it will drop off. Subsequently friction holds the cover 6 in position although snap detents like the formations 22 can be provided to hold it closed.

We claim:

1. A box for the storage and display of elongated objects, the box comprising:

a base part having a floor having a pair of parallel side edges and an end edge bridging the side edges, respective side walls projecting upward from the side edges and in turn having upper edges, and an outer end wall bridging the side walls and projecting upward from the end edge;

a cover part having a face plate, hinged on the base part, and pivotal thereon between an open position projecting upward from the base part and a closed position with the face plate lying wholly within the base part below the upper edges of the side walls, the cover part being formed with a laterally projecting grip tab coplanar with the face plate; and a frangible latch element connected between the cover and base parts in the closed position of the cover part and retaining same therein, whereby the cover part can only be moved into the open position after breaking of the latch element.

2. The storage and display box defined in claim 1 wherein the base side walls are each formed with a cutout opening at the respective upper edge, the cover part having two such tabs projecting in the closed position into the respective cutouts, the cover part further having side walls lying in the closed position between and inwardly against the respective base side walls and covering the cutouts.

3. The storage and display box defined in claim 2 wherein the cutouts are generally half elliptical and the cover side walls are formed at the cutouts in the closed position with grip-enhancing ridges.

4. The storage and display box defined in claim 2 wherein the base part is formed at the end wall with an extension formed in turn with a throughgoing aperture and the end wall is formed at the aperture with a downwardly opening slot, the latch element having a thin neck part engaged through the slot.

5. The storage and display box defined in claim 4 wherein the base part is formed with an inner end wall parallel to but spaced from the outer end wall and the latch element has an inner portion lying between the first and second end walls.

6. The storage and display box defined in claim 5 wherein the first and second end walls form a passage snugly receiving the latch-element inner portion and this inner portion has a projection extending toward the cover, the cover having a ridge engaging under the projection in the closed position.

7. The storage and display box defined in claim 6 wherein the passage and inner portion are of complementary rectangular section.

8. The storage and display box defined in claim 5 wherein the latch element has a head in the aperture and the thin neck portion extends through the slot between the head and inner portion.

9. The storage and display box defined in claim 4 wherein the extension is formed with a throughgoing hanging hole.

10. The storage and display box defined in claim 1, further comprising an insert pivoted between the base part and the cover part and formed with seats for the objects, the parts having formations elastically retaining the insert in different positions relative to the base part.

* * * * *